US012435481B2

(12) United States Patent
Geiger

(10) Patent No.: US 12,435,481 B2
(45) Date of Patent: Oct. 7, 2025

(54) METHOD OF INSTALLING A CUTTING WHEEL OF A SLURRY WALL CUTTER

(71) Applicant: Liebherr-Werk Nenzing GmbH, Nenzing (AT)

(72) Inventor: Luis Geiger, Bludenz (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 876 days.

(21) Appl. No.: 17/546,569

(22) Filed: Dec. 9, 2021

(65) Prior Publication Data

US 2022/0186456 A1 Jun. 16, 2022

(30) Foreign Application Priority Data

Dec. 11, 2020 (DE) ..... 10 2020 133 211.4

(51) Int. Cl.

| | |
|---|---|
| ***E02D 17/13*** | (2006.01) |
| ***E02F 5/02*** | (2006.01) |
| ***E02F 5/08*** | (2006.01) |
| *E02F 3/18* | (2006.01) |
| *E02F 3/24* | (2006.01) |

(52) U.S. Cl.

CPC ..... *E02D 17/13* (2013.01); *E02F 5/08* (2013.01); *E02F 3/188* (2013.01); *E02F 3/241* (2013.01); *E02F 5/02* (2013.01)

(58) Field of Classification Search

CPC .. E02F 5/08; E02F 3/188; E02F 3/241; E02D 17/13

USPC ..... 37/91, 189

See application file for complete search history.

(56) References Cited

U.S. PATENT DOCUMENTS

| | | | | |
|---|---|---|---|---|
| 4,542,940 | A | 9/1985 | Marten | |
| 4,991,322 | A * | 2/1991 | Detilleux | E02F 9/2866 37/189 |
| 5,501,122 | A | 3/1996 | Leicht et al. | |
| 10,517,235 | B2 * | 12/2019 | Casper | A01G 23/067 |

FOREIGN PATENT DOCUMENTS

| | | | | |
|---|---|---|---|---|
| CN | 106436798 | A | 2/2017 | |
| CN | 107855745 | A | 3/2018 | |
| CN | 111376016 | A | 7/2020 | |
| DE | 102004026849 | B3 * | 11/2005 | B27B 5/34 |
| DE | 202019102438 | U1 | 5/2020 | |
| EP | 1975323 | A1 * | 10/2008 | E02D 17/13 |
| EP | 2597205 | A1 | 5/2013 | |
| EP | 2597205 | B1 * | 4/2014 | E02D 17/13 |
| WO | WO-2006058840 | A1 * | 6/2006 | B23C 5/109 |

OTHER PUBLICATIONS

Chinese Office Action mailed Apr. 22, 2025 in Application No. 2021115050179.

* cited by examiner

*Primary Examiner* — Christopher J Sebesta
*Assistant Examiner* — Audrey L Lusk
(74) *Attorney, Agent, or Firm* — Dilworth & Barrese, LLP

(57) ABSTRACT

The invention is directed to a method of installing a cutting wheel at a cutting wheel transmission of a slurry wall cutter by means of centering elements and spacer elements, the slurry wall cutter having at least one cutting wheel transmission and a cutting wheel that can be installed at the cutting wheel transmission.

20 Claims, 6 Drawing Sheets

METHOD OF INSTALLING A CUTTING WHEEL OF A SLURRY WALL CUTTER

BACKGROUND OF THE INVENTION

The present invention relates to a method of installing a cutting wheel at a cutting wheel transmission of a slurry wall cutter, a kit for carrying out the method by means of centering elements and spacer elements, and a slurry wall cutter having at least one cutting wheel transmission and a cutting wheel that can be installed at the cutting wheel transmission by means of the method in accordance with the invention.

Slurry wall cutters are used to prepare slurry trenches for the construction of slurry walls and are available in the most varied designs and sizes. Slurry wall cutters are typically mounted on mobile carrier machines such as mobile cranes or cable excavators.

A key component of such slurry wall cutters are the cutting wheels that are supported on rotationally drivable cutting wheel transmissions in the lower region of a housing of the slurry wall cutter. The cutting wheels are exposed to high wear and have to be replaced and/or serviced correspondingly frequently. The installation and deinstallation of the cutting wheels at the cutting wheel transmissions is at times very difficult due to their high weight and the poor accessibility of the fastening means, but simultaneously requires high precision. For this reason, this procedure can be very time intensive and laborious.

The cutting wheels have previously been installed without special aids in slurry wall cutters known from the prior art. The alignment of the cutting wheels with the cutting wheel transmissions is here typically effected by hand. With the aid of tools such as crowbars the cutting wheels are typically manipulated for so long until all the connection points or fastening means are aligned at the cutting wheel and the cutting wheel transmission. The pushing of the cutting wheel onto the cutting wheel transmission takes place by the final screw connection.

SUMMARY OF THE INVENTION

It is therefore the object of the present invention to simplify and accelerate the installation and deinstallation of such slurry wall cutters. A simple and precise alignment of the cutting wheels should in particular be made possible and at the same time sensitive components should be protected from damage.

This object is achieved in accordance with the invention by a method having the features herein. A method of installing a cutting wheel at a cutting wheel transmission of a slurry wall cutter is accordingly proposed, wherein the cutting wheel transmission and the cutting wheel each fastening means for fastening the cutting wheel to the cutting wheel transmission and wherein at least two spacer elements are arranged at the cutting wheel transmission.

The method in accordance with the invention comprises the following steps:

- guiding the cutting wheel to the cutting wheel transmission, for example by means of lifting equipment;
- roughly aligning the cutting wheel relative to the cutting wheel transmission so that the fastening means of the cutting wheel and the cutting wheel transmission are opposite one another, without contacting one another in so doing;
- connecting one respective centering element to the spacer elements;

- finely aligning the cutting wheel relative to the spacer elements by means of the centering elements so that the fastening means still do not contact one another; and
- displacing the cutting wheel relative to the spacer elements by means of the centering elements, with the fastening means come into engagement with one another.

The idea in accordance with the invention is therefore to carry out the fine alignment of the cutting wheel relative to the cutting wheel transmission and the final pushing of the cutting wheel onto the cutting wheel transmission that effects or enables the establishment of the connection via separately provided centering elements. The latter cooperate with the spacer elements at the cutting wheel transmission that enable the fine alignment without the fastening means contacting one another.

The spacer elements in particular serve as spacers until the correct alignment of the cutting wheel has been found and so protect the fastening means from damage. At the same time the spacer elements represent the reference points for the fine alignment of the cutting wheel and the anchor points for the pushing of the cutting wheel onto the cutting wheel transmission. Both movements take place using the centering elements that thus have a dual function. The fine alignment of the cutting wheel in particular takes place here by rotation of the cutting wheel about its central axis. The centering elements can furthermore prevent a sliding of the cutting wheel from the cutting wheel transmission as a third function.

The fastening elements can be pins/bolts and associated bores. If therefore it is stated in the present case that they do not contact one another (e.g. during the rough or fine alignment), this in particular means that there is a certain spacing between the fastening means when viewed from the side and the pins are e.g. not traveled into the bores.

Advantageous embodiments of the invention result from the following description. During or before the rough alignment, the cutting wheel can already be pushed onto the cutting wheel transmission or onto a transmission hub of the cutting wheel transmission so that the cutting wheel lies on the cutting wheel transmission or on the transmission hub during the fine alignment and possibly already during the rough alignment. The rough alignment and/or fine alignment then takes/take place by rotation of the cutting wheel. On the guiding on of the cutting wheel, the latter can already be pushed onto the cutting wheel transmission, with the rough alignment taking place by a subsequent rotation relative to the cutting wheel transmission to position the fastening means such that they are opposite one another. Since this step in particular takes place without any aids for the alignment, a fine alignment is subsequently necessary so that the fastening means are precisely aligned or are aligned with one another. It is, however, equally conceivable that the cutting wheel is already rotated into the correct position during the guiding so that the pushing of the cutting wheel onto the transmission hub takes place with the step of the rough alignment.

Provision is made in a possible embodiment that the spacer elements and/or the fastening elements arranged at the cutting wheel transmission project perpendicular from the outer side of the cutting wheel transmission facing the cutting wheel and are preferably distributed over the periphery. The outer side of the cutting wheel transmission can be the transmission cover. It can, but does not have to be removable or openable.

Provision is made in a further possible embodiment that the spacer elements come into contact with the cutting wheel on the displacement or pushing on of the cutting wheel earlier than the fastening means, with the spacer elements preferably having a greater length than the fastening means arranged at the cutting wheel transmission. The spacer elements thus act as spacers. They come into contact with the cutting wheel first and furthermore facilitate a fine alignment of the cutting wheel in interaction with the centering elements. Since the fastening elements of the cutting wheel transmission are not in engagement, in particular because they are shorter than the spacer elements, they are protected from damage. Only when the cutting wheel has been completely correctly positioned, can it be pushed further onto the cutting wheel transmission so that the fastening means of the cutting wheel and the cutting wheel transmission contact one another or move into one another.

Provision is made in a further possible embodiment that the fastening means arranged at the cutting wheel transmission are bolts or pins, in particular threaded pins, and the fastening means arranged at the cutting wheel are bores, with the pins being pushed through the bores ("coming into engagement") on the displacement of the cutting wheel relative to the spacer elements or on the pushing of the cutting wheel onto the cutting wheel transmission at the end of the installation procedure. The pins pushed completely into or through the bores are preferably secured by means of securing elements, in particular nuts. The cutting wheel is thereby fixedly fastened to the cutting wheel transmission and the installation procedure is concluded.

Provision is made in a further possible embodiment that the centering elements are connected to the spacer elements from the side of the cutting wheel remote from the cutting wheel transmission. The connection of the centering elements can take place immediately here, that is directly with the spacer elements, or indirectly, for example via a connection element. Cutouts are preferably provided through which the centering elements can be connected to the spacer elements. The connection of the centering elements to the spacer elements (or to the connection elements) in particular takes place via a screw connection. For this purpose, the centering elements and/or the spacer elements can have corresponding threaded bores and/or threaded pieces.

Once the cutting wheel has been installed, the centering elements are preferably removed from the spacer elements. It is, however, likewise conceivable that they remain at the spacer elements or are supported at special holding means of the slurry wall cutter. The centering elements are in particular portable.

Provision is made in a further possible embodiment that one cutout per spacer element is formed at a fastening flange of the cutting wheel. The fastening flange can be configured in annular form at or in a hub of the cutting wheel and can extend perpendicular to the front side or outer side of the cutting wheel transmission. On the displacement of the cutting wheel relative to the spacer elements, the latter travel into the cutouts. They were previously aligned with one another by the fine alignment so that they are aligned with one another.

The spacer elements preferably remain at the cutting wheel transmission after the installation of the cutting wheel has taken place. Just like the fastening means, they can be securable by means of securing elements or nuts. It is likewise conceivable that after the installation has been completed, cover elements are attached to the spacer elements, for example to close threaded bores of the spacer elements and thus to protect them from penetration by dirt or waste.

Provision is made in a further possible embodiment that the centering elements are connected to the spacer elements through the cutouts, with the centering elements being moved in the direction of the cutting wheel transmission for the fine alignment and/or the displacement of the cutting wheel. The centering elements and the spacer elements are preferably connected to one another via threaded pins that extend through the cutouts. The centering elements are then screwed onto the threaded pins that are preferably rotationally rigidly connected to the spacer elements, in particular screwed into them.

By a continued screwing of the centering elements onto the threaded pins, the former move in the direction of the spacer elements or of the cutting wheel transmission. In this respect, from a certain distance onward, the fine alignment of the cutting wheel can take place first that is effected by an interaction with the cutting wheel or the contacting of the cutting wheel (in particular at the edges of the cutouts). The displacement of the cutting wheel relative to the spacer elements, that in particular corresponds to a further pushing of the cutting wheel onto the cutting wheel or onto the cutting wheel hub, is preferably effected after the fine alignment by a continued screwing of the centering elements onto the threaded pins. In the simplest case, the centering elements in this respect press against the cutting wheel and thereby push it in the direction of the cutting wheel transmission.

Provision is made in a further possible embodiment that the centering elements have a conical section that preferably cooperates with the respective cutout on the moving of the centering elements in the direction of the spacer elements or of the cutting wheel transmission and that fine aligns the cutting wheel such that the spacer elements are aligned with the associated cutouts.

The end of the conical section that faces the cutout and that can simultaneously represent an end of the centering element in this respect has a smaller outer diameter than the inner diameter of the cutout. This end of the conical section thereby travels into the cutout on the movement of the centering element. Even if the centering element and the cutout are not preferably aligned with one another, are in particular not in collinear alignment, before the fine alignment, the "threading in" is facilitated by the conical shape.

On a further movement of the centering elements in the direction of the cutting wheel transmission, the chamfered shape of the centering element presses against the edge of the cutout so that the cutting wheel rotates about its axis of rotation (a slight displacement of the axis of rotation is also possible here) and a precise or collinear alignment of the centering element and thus also of the spacer element toward the cutout is automatically achieved. For an optimum fine alignment, the conical section can have a maximum diameter that just corresponds to the inner diameter of the cutout (or is slightly smaller so that the centering element does not block or cant).

Provision is made in a further possible embodiment that the centering elements have a preferably peripheral first abutment in the region of the conical section, said first abutment contacting the cutting wheel after the fine alignment. The first abutment preferably adjoins the end of the conical section with a maximum diameter. When the first abutment abuts the cutting wheel or the fastening flange, the fine alignment is completed. On a continued movement of the centering element in the direction of the cutting wheel transmission (in particular by a further screwing), the abutment likewise presses the cutting wheel in the direction of the cutting wheel transmission, with the cutout moving relative to the associated spacer element and the latter thereby traveling into the cutouts. The first abutment can be a region formed in one piece with the centering element and having a diameter that is larger than the inner diameter of the cutout.

The centering element can generally have a substantially cylindrical shape with one of the ends being able to be conically shaped and forming the conical section for the fine alignment. The centering element can have one or more grips or grip elements that facilitate the screwing. Receptacles can likewise be provided for tools by means of which the centering elements can be screwed more easily. The centering elements are in particular rotationally symmetrical. The axial end regions of the centering elements preferably differ from one another, however.

Provision is made in a further possible embodiment that the first abutments also press the cutting wheel in the direction of the cutting wheel transmission on the continued movement, in particular screwing, of the centering elements in the direction of the cutting wheel transmission so that the spacer elements travel into the respective cutouts. The cutting wheel is here ideally displaced simultaneously with all the centering elements in this respect, with a plurality of persons being required for this purpose, however. Alternatively, each centering element can also be respectively displaced by a short distance after one another so that no canting of the cutting wheel or of the spacer elements and/or of the fastening means occurs.

Provision is made in a further possible embodiment that the centering elements are connected to the spacer element via threaded pins, are movable by screwing in the direction of the spacer elements or of the cutting wheel transmission, and have a continuous threaded bore for receiving the threaded pins. The centering element can therefore preferably be screwed onto the threaded pin from both sides, with one of the ends in particular having or representing the conical section.

The centering elements preferably each have a second abutment at their ends remote from the conical sections. After the displacement of the cutting wheel by a first distance relative to the spacer elements in the direction of the cutting wheel transmission by means of the centering elements, they are unscrewed from the threaded pins, turned around, and screwed back onto the threaded pins at the other end until the second abutments abut the cutting wheel or the fastening flange. On a continued screwing of the centering elements, the cutting wheel is then further displaced in the direction of the cutting wheel transmission.

The first abutment therefore serves the first displacement of the cutting wheel by a first distance directly subsequent to the fine alignment. After the turning around of the centering element, the cutting wheel is then pushed by the remaining distance onto the cutting wheel transmission until the respective fastening means are completely in engagement with one another.

Provision is made in a further possible embodiment that the centering elements have recesses opening into the threaded bores at their ends remote from the conical sections, with the spacer elements traveling into the recesses of the centering elements until the fastening means of the cutting wheel and of the cutting wheel transmission are completely in engagement with one another after the repeat screwing onto the threaded pins and a continued displacement of the cutting wheel in the direction of the cutting wheel transmission.

In a further possible embodiment, at least two pre-centering elements are provided that are arranged at the side of the cutting wheel facing the cutting wheel transmission and each have a chamfered surface. The cutting wheel is thus first pushed via the precentering elements onto the cutting wheel transmission on the guiding toward the cutting wheel transmission and is precentered relative to the cutting wheel transmission via the chamfered surfaces so that the axes of rotation of the cutting wheel and of the cutting wheel transmission are substantially collinear.

The rough alignment and the fine alignment then subsequently take place in each case by a rotation of the cutting wheel relative to the cutting wheel transmission. In this respect, however, the axis of rotation of the cutting wheel can also be slightly displaced so that it is fully collinear with the axis of rotation of the cutting wheel transmission at least after the fine alignment.

The precentering elements so-to-say extend the contact surface of the cutting wheel on the cutting wheel transmission or on the transmission hub. The cutting wheel therefore first contacts the cutting wheel transmission via the precentering elements on the guiding on. The chamfered surfaces facilitate the pushing on or "threading in" and provide an automatic precentering. The precentering elements can be configured as arc segment shaped centering blocks and can, for example, be fastenable to the cutting wheel by means of screws. After installation has taken place, they can either remain at the cutting wheel or be subsequently removed again.

Three spacer elements are preferably provided per cutting wheel and correspondingly three centering elements. Three precentering elements are preferably likewise provided.

The present invention furthermore comprises a kit for a slurry wall cutter for the carrying out of the method in accordance with the invention. The kit comprises at least two centering elements and at least two spacer elements, preferably three centering elements and three spacer elements. The kit can additionally comprise at least two, preferably three, threaded pins for connecting the centering elements to the spacer elements and/or at least two, preferably three, of the above-described precentering elements. In this respect, the same advantages and properties obviously result as for the method in accordance with the invention so that a repeat description will be dispensed with at this point.

The kit can be used for the cutting wheel installation with conventional slurry wall cutters. The spacer elements can, for example, have a thread that can be screwed into already present bores at known cutting wheel transmissions or transmission covers. The cutouts associated with the spacer elements can be already present bores for fastening pins of the cutting wheel transmission. The above-described precentering elements, if they are used with cutting wheels of the category without separate bores provided for the precentering elements, can be able to be pushed on or otherwise reversibly connected to the cutting wheel. The centering elements are in particular separate parts and are coordinated with the shape of the spacer elements. In this case, the method can also be carried out with slurry wall cutters of the category by means of the kit in accordance with the invention. No modification of the cutting wheels and/or cutting wheel transmissions therefore has to take place here.

The present invention further relates to a slurry wall cutter having at least one cutting wheel transmission and a cutting wheel that can be installed thereon by means of the method in accordance with the invention. The slurry wall cutter preferably comprises a kit in accordance with the invention. In this respect, the same advantages and properties obviously result as for the method or for the kit in accordance with the invention so that a repeat description will be dispensed with at this point.

The slurry wall cutter can have two or four cutting wheels that can all be installed on the respective cutting wheel transmission by means of the method in accordance with the invention. The centering elements and, where applicable, the threaded pins, can here be used for all four cutting wheels so that twice or four times the number does not have to be kept available. The attachment of the cutting wheels in particular anyway takes place sequentially. The spacer elements, however, preferably remain at the respective cutting wheel transmissions so that a corresponding number has to be provided per cutting wheel.

BRIEF DESCRIPTION OF THE DRAWINGS

Further features, details, and advantages of the invention result from the embodiments explained in the following with reference to the Figures. There are shown.

DESCRIPTION OF THE PREFERRED EMBODIMENTS

Figure 1:
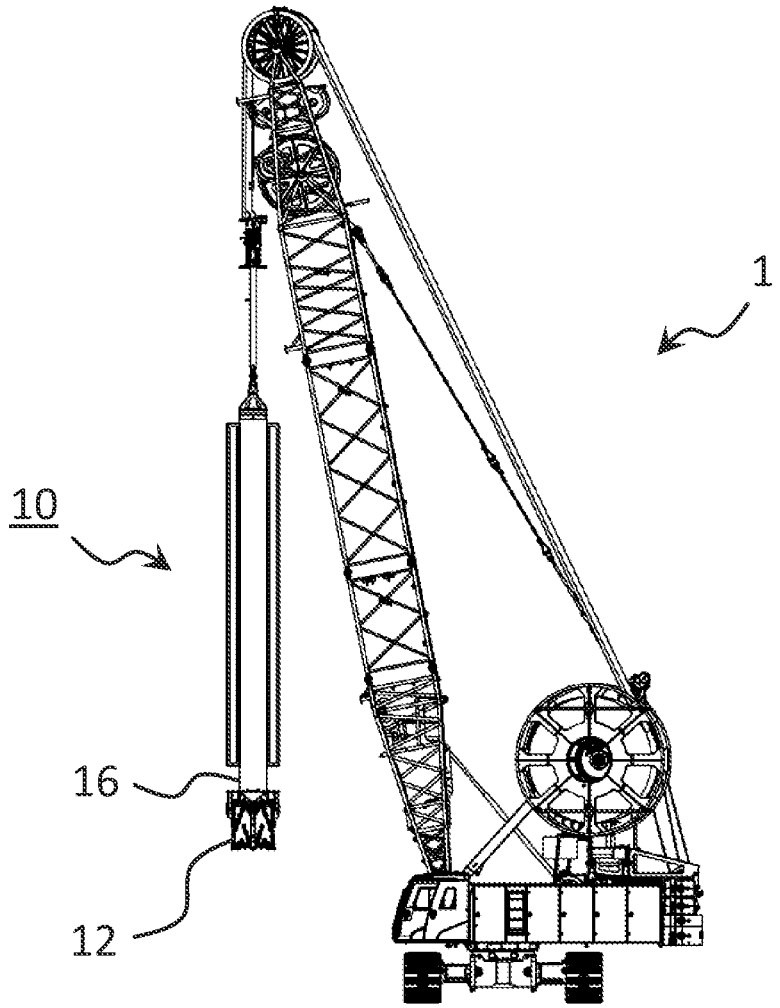
FIG. 1: a carrier machine having a slurry wall cutter in a side view.

FIG. 1 shows a carrying machine 1 having a slurry wall cutter 10 suspended at a boom of the carrying machine 1 in a side view. The slurry wall cutter 10 comprises a housing 16 at whose lower end a plurality of cutting wheels 12 are located that are installed on rotationally drivable cutting wheel transmissions 14. A total of four cutting wheels 12 are typically present, with embodiments having two or more than four cutting wheels 12 also being conceivable.

Figure 2:
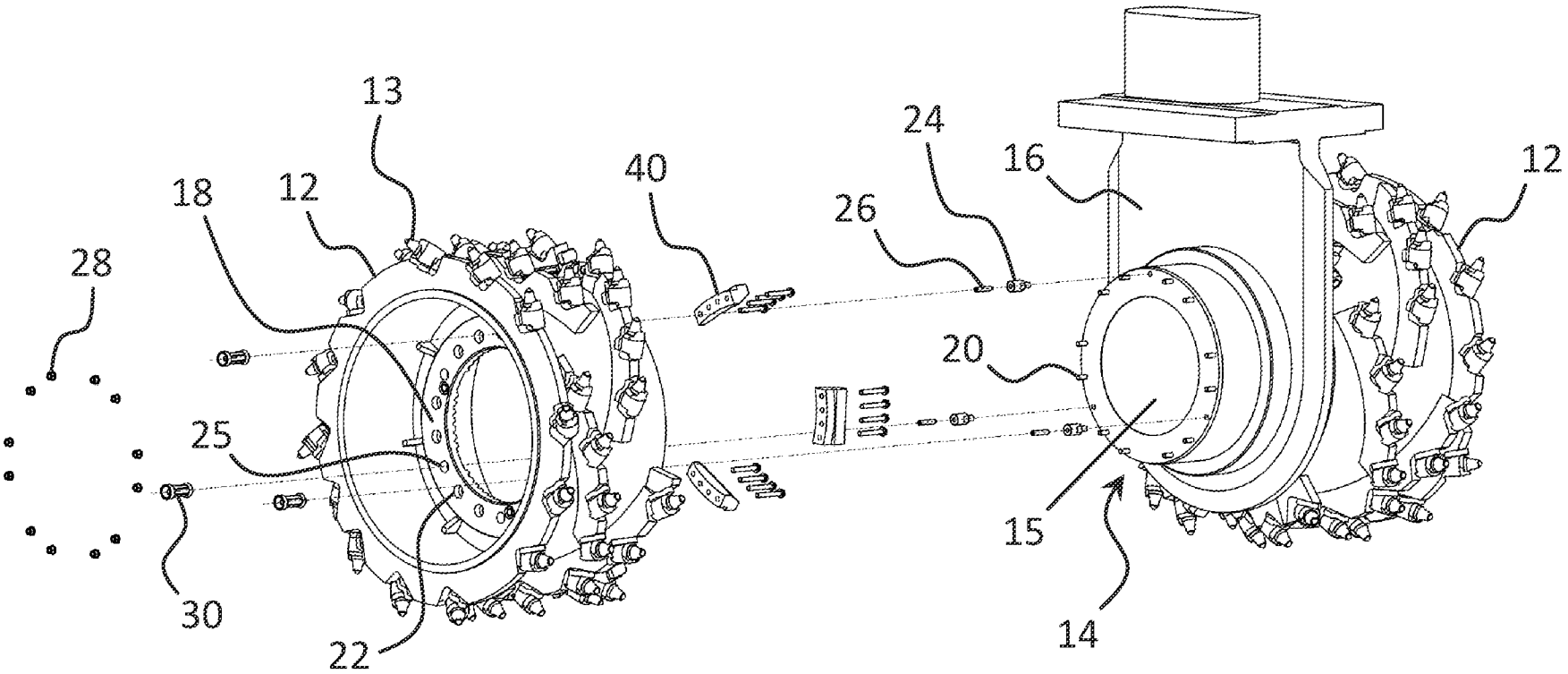
FIG. 2: a perspective view of an embodiment of the slurry wall cutter in accordance with the invention in the region of the cutting wheels, with one of the cutting wheels being shown in an exploded illustration.

FIG. 2 shows a detail of an embodiment of the slurry wall cutter 10 in accordance with the invention in the region of the cutting wheels 12, with here only two cutting wheels 12 being shown. One of the two cutting wheels 12 is shown in an exploded view. Sight of the cutting wheel transmission 14 is thereby revealed that can also be called a cutting wheel hub or transmission hub onto which the cutting wheel 12 can be pushed for installation. At the front side, the cutting wheel transmission 14 has a transmission cover 15 that has a plurality of fastening means 20 that are distributed over the periphery for the fastening of the cutting wheel 12 and that project perpendicularly from the transmission cover 15.

The cutting wheel 12 has a plurality of cutting teeth 13 at the outer periphery and a peripheral fastening flange 18 inwardly. A plurality of bores 22 are provided in the latter that are configured and arranged to match the fastening means 20 of the cutting wheel transmission 14 and that form the fastening means 22 of the cutting wheel 12. For the installation, the cutting wheel 12 is pushed onto the cutting wheel transmission 14 and the fastening means 20 of the cutting wheel transmission 14 are pushed through the associated bores 22. The fastening means 30, that are in particular configured as threaded pins or as bolts having threaded sections at the end sides, are subsequently secured by securing elements or nuts 28.

Figure 4:
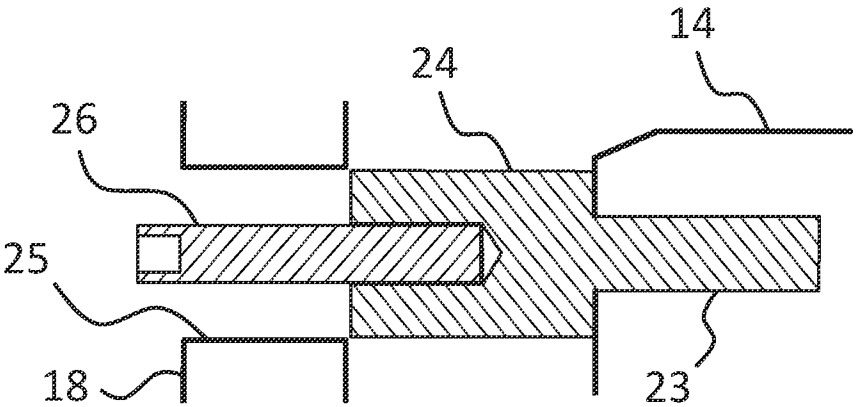
FIGS. 4-9: schematic sectional views of different steps of the method in accordance with the invention in accordance with an embodiment, with the parts shown in FIG. 3 being used.

In addition to the fastening means, three spacer elements 24 are arranged at the transmission cover 15 that are each screwed via a threaded section in corresponding bores 23 of the transmission cover 15 (cf. FIG. 4). The part of the spacer element 24 projecting from the transmission cover 15 is of bolt or cylinder shape and forms a spacer bolt that has a greater length than the fastening means 20.

The spacer elements 24 have a central threaded bore 27 at the ends projecting from the transmission cover 15 (cf. FIG. 3) into which the threaded pins 26 are screwed. Three of the bores of the fastening flange 18 of the cutting wheel form cutouts 25 through which the spacer elements 24 are pushed on the installation of the cutting wheel 12.

Three centering elements 30 whose function will be described further below and that form parts separate from the cutting wheel 12 or from the slurry wall cutter 10 are provided for the fine alignment of the cutting wheel 12 before the fastening means 20, 22 come into engagement with one another and for the controlled pushing of the cutting wheel 12 onto the cutting wheel transmission 14.

The cutting wheel 12 furthermore has three precentering elements 40 fastened to the side facing the cutting wheel transmission 14 via screws and configured as centering blocks 40. The centering blocks 40 follow the inner periphery of the cutting wheel 12 at their inner side facing the axis of rotation of the cutting wheel 12 and thus form extended contact surfaces of the cutting wheel 12 on the cutting wheel transmission 14 that come into contact with the transmission hub first on the installation. The centering blocks 14 are chamfered in the direction of the cutting wheel transmission 14 at the inner sides and so facilitate the pushing or the "threading" onto or into the cutting wheel transmission 14. They furthermore thereby provide a precentering of the cutting wheel 12 relative to the cutting wheel transmission 14 on the pushing on so that the inner diameter of the cutting wheel 12 is subsequently aligned with the outer diameter of the transmission hub or of the cutting wheel transmission 14 or so that the respective axes of rotation are substantially collinear.

Figure 3:
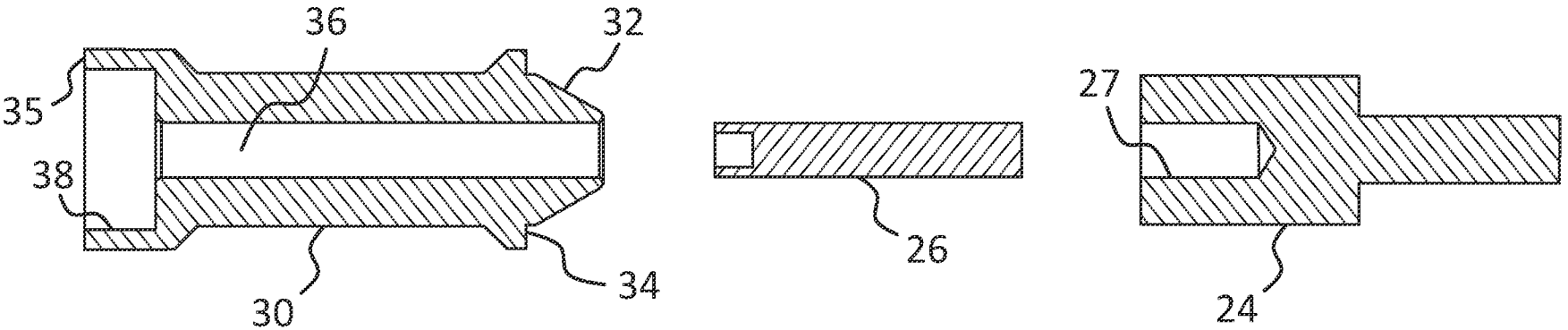
FIG. 3: a centering element, a spacer element, and a threaded pin in accordance with an embodiment in accordance with the invention in a side view in each case.

FIG. 3 shows embodiments of the centering element 30, of the threaded pin 26, and of the spacer element 24 of the slurry wall cutter 10 in accordance with the invention, with lateral sectional views along their longitudinal axes being shown. The threaded sections of the three parts are not separately drawn here.

The spacer element 24 has already been described further above. The threaded pin 26 has a greater length than the threaded bore 27 of the spacer element 34 and has a recess for a tool at the end remote from the spacer element 24, whereby it can be simply and fixedly screwed in.

The centering element 30 has a continuous threaded bore 37 (or a bore 36 that respectively has an inner thread at at least the two end sections) that extends along the longitudinal axis. Alternatively, however, two blind hole threaded bores could also be provided from both ends.

The end of the centering element 30 facing the spacer element 24 is conically shaped and tapers toward the end. This conical section 32 serves the fine alignment of the cutting wheel 12 prior to the final connection. A peripheral first abutment 34 whose abutment surface is perpendicular on the longitudinal axis of the centering element 30 adjoins the conical section 32. The centering element 30, that can also be called a centering cone, is formed in one piece in this embodiment, but can also consist of a plurality of installed parts.

An embodiment of the method in accordance with the invention for installing the cutting wheel 12 at the cutting wheel transmission 14 will be described in the following with reference to FIGS. 4-9.

In the first step, the cutting wheel 12 is prepositioned roughly toward the transmission hub or the cutting wheel transmission 14. It is ensured by the centering blocks 40 on the rear side of the cutting wheel 12 that the inner diameter of the cutting wheel 12 is in alignment with the transmission hub 14. It is thereby possible to push the cutting wheel 12 on so far until the spacer elements 24 arranged at the front side of the cutting wheel transmission 14 contact the fastening flange 18 of the cutting wheel 12 if they are not already aligned with the cutouts 25 in the flange ring 18.

Since the spacer bolts of the spacer elements 24 (that is the parts projecting from the transmission cover 15) are longer than the fastening elements 20, the cutting wheel 12 first contacts them on the pushing on and cannot come into contact with the fastening means 20. The spacer elements 24 thus protect the fastening means 20 from damage. The spacer elements 24 can optionally comprise damping elements and/or can consist of a shockproof material.

The rough alignment of the cutting wheel 12 takes place in the direction of rotation in this state. In this respect, the spacer elements 24 align with the cutouts 25 in the fastening flange 18 by so much that the threaded pins 26 can be used for pulling the cutting wheel 12 into the spacer elements 24. The threaded pins 26 extend through the cutouts 25 in the screwed in state (cf. FIG. 4).

Once this has been done, the centering elements 40 are screwed onto the threaded pins 26 from the side remote from the cutting wheel transmission 14. If they are displaced by a certain distance by the screw movement, the conical sections 32 abut the edges of the cutouts 25 and automatically effect the exact alignment of the cutouts 25 with the spacer elements 24 and thereby a fine alignment of the cutting wheel 12 relative to the cutting wheel transmission 14. This fine alignment can effect a rotation (cf. arrow b1 in FIG. 5) and/or displacement of the cutting wheel 12 relative to the cutting wheel transmission 14. After the fine alignment, the fastening means 20 are aligned with the associated bores 22.

Figure 5:
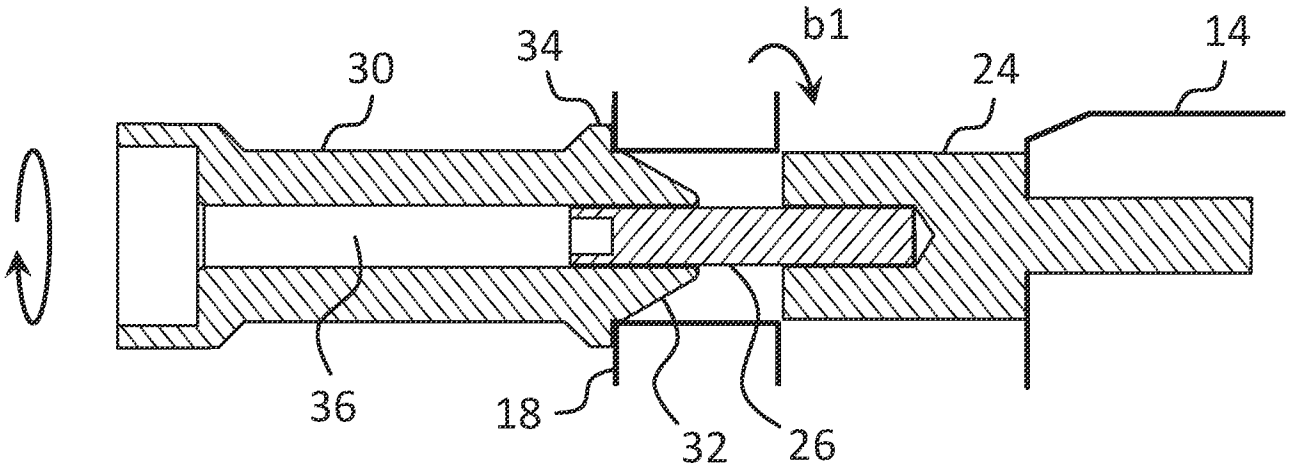
Figure 6:
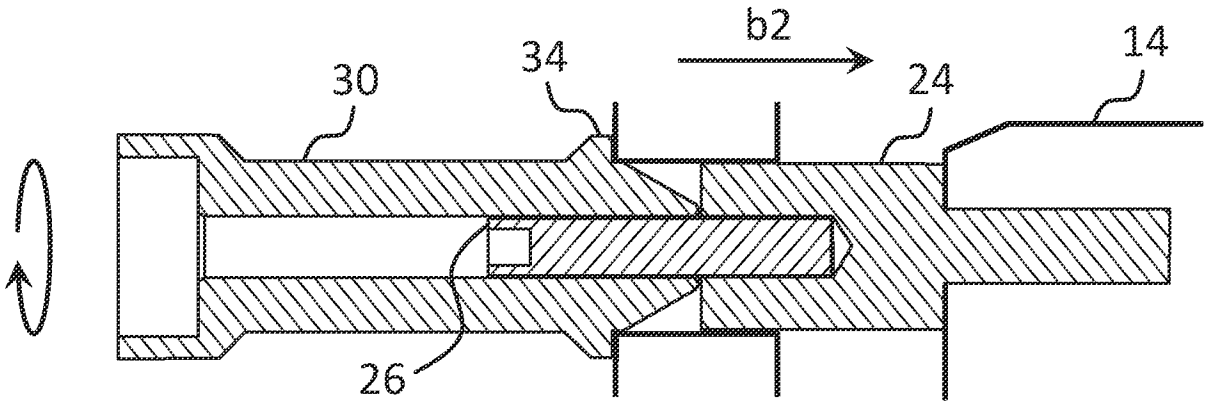

FIG. 5 shows the situation directly subsequent to the completely performed fine alignment of the cutting wheel 12. The conical section 32 has here completely penetrated into the cutout 25 and the first abutment 34 of the centering element 30 abuts the side of the fastening flange 18 remote from the cutting wheel transmission 14. The spacer element 24 is still located outside the cutout 25.

The cutting wheel 12 can now be pushed onto the cutting wheel transmission 14 in that the centering elements 30 are turned further or are screwed onto the threaded pins 36. In this respect, the centering elements 30 push the fastening flange 18 via the first abutments 34 and thus the whole cutting wheel 12 for so long in the direction of the cutting wheel transmission 14 (cf. arrow b1 in FIG. 6) until the tip of the centering element 30 abuts the front side of the spacer element 24 (cf. FIG. 6). In this respect, the spacer elements 34 have still not been completely pushed into the cutouts 25.

The centering elements 30 are now turned over and are again screwed onto the threaded pins 26 from the other end. At the ends remote from the conical sections 32, the centering elements 30 have a central recess 38 whose inner diameter is greater than the outer diameter of the spacer elements 24. The front sides of these ends form second abutments 35 running circularly around the recesses 38.

Figure 7:
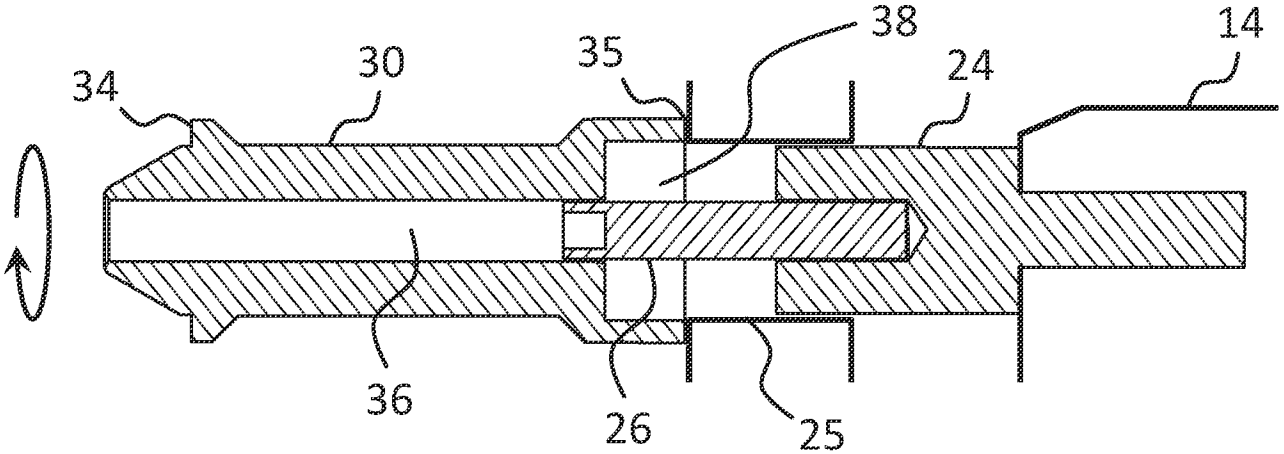

The centering elements 30 are now screwed onto the threaded pins 25 with the second abutments 35 facing the front until the second abutments 35 abut the fastening flange 18 (cf. FIG. 7). This additionally provides the advantage of a local frictional connection between the cutting wheel 12 and the cutting wheel transmission 14 so that no counterhold or no securing device is required at the slurry wall cutter 10 itself. There is no risk of the slurry wall cutter 10 evading during the pushing procedure or of the cutting wheel 12 slipping off the cutting wheel transmission 14.

Figure 8:
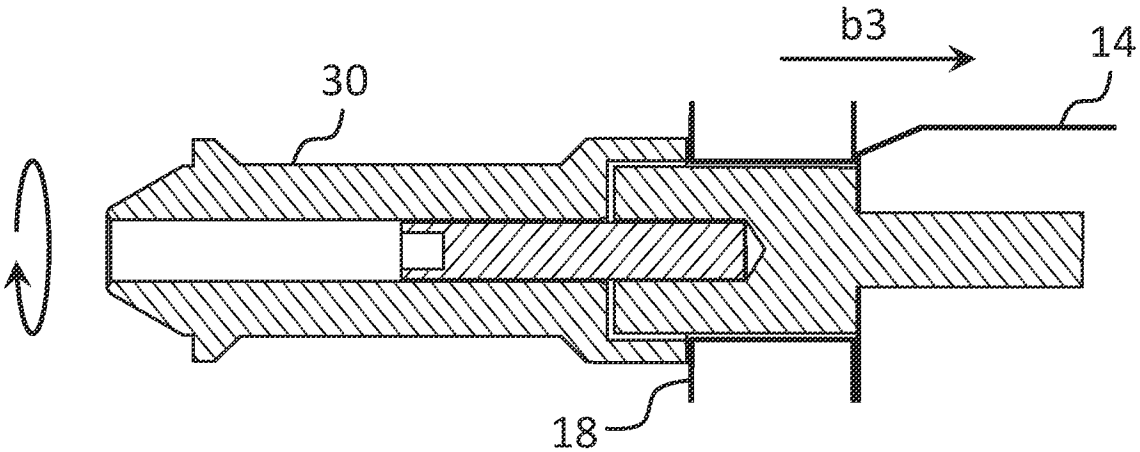

By a continued turning around or screwing on, the centering elements 30 urge the cutting wheel 12 further in the direction of the cutting wheel transmission 14 and push the cutting wheel 12 completely thereon until the fastening flange 18 abuts the transmission cover 16 (or at least adopts a minimal distance therefrom). The spacer elements 24 in this respect travel into the recesses 38 of the centering elements 30. This end position is shown in FIG. 8. The pushing on without canting is ensured by a uniform tightening of all three centering elements 30. In this respect, the spacer elements 24 travel completely into the cutouts 25 and the fastening means 20 travel completely into the associated bores 22.

Figure 9:
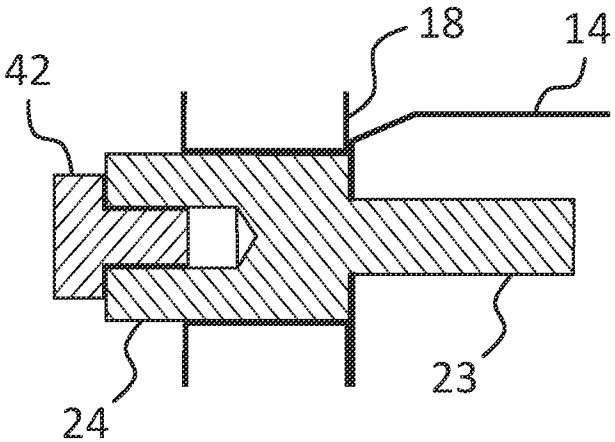

The nuts 28 can subsequently be comfortably placed onto the fastening means 20 projecting through the bores 22 and tightened for the fastening of the cutting wheel 12 on the cutting wheel transmission 14. Once this has been done, the centering elements 30 and the associated threaded pins 26 are removed. The spacer elements 24 remain in the cutting wheel transmission 14, with their threaded bores 27 being protected by cover elements 44 configured as closure screws as is shown in FIG. 9. The centering blocks 40 can likewise remain at the cutting wheel 12 or can be removed after the installation and e.g. used for the installation of other cutting wheels 12.

Figure 10:
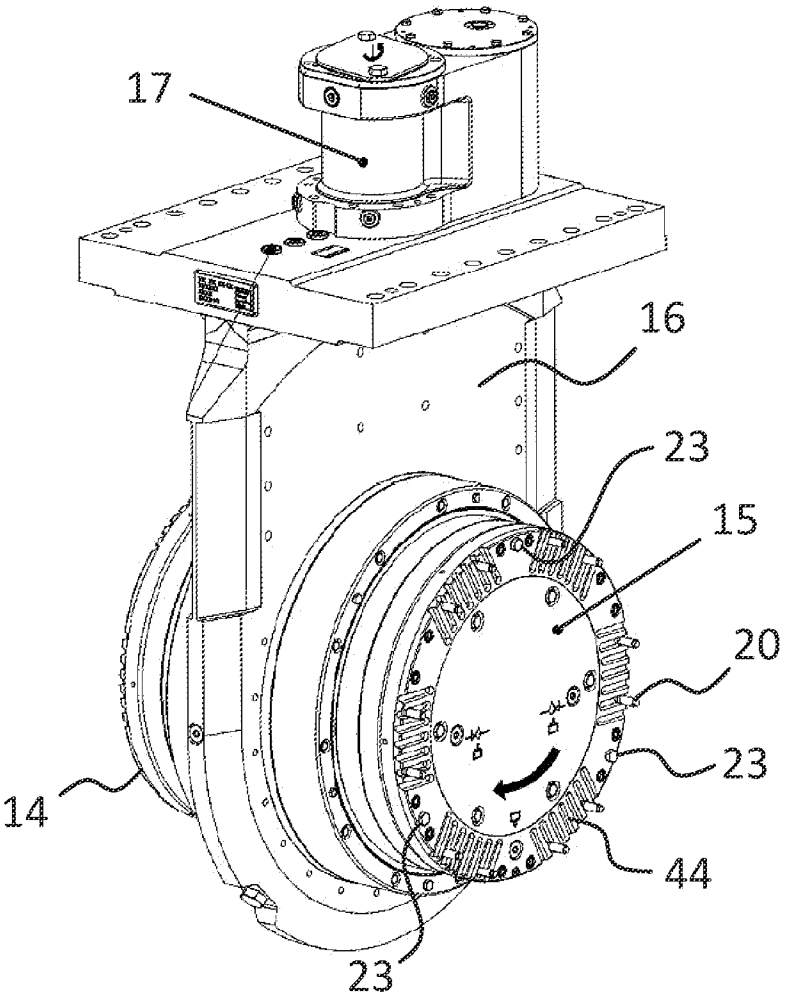
FIG. 10: a perspective view of an embodiment of the slurry wall cutter in accordance with the invention in the region of the cutting wheel transmission, with further details being shown in comparison with FIG. 2.

A further embodiment of the slurry wall cutter 10 in accordance with the invention is shown in FIG. 10 in the region of the cutting wheel transmission 14 without cutting wheels 12, with further details being shown here. A drive unit 17 can thus e.g. be recognized here that drives the two cutting wheel transmissions 14 shown. In this respect, it can be a hydraulic motor. A toothed arrangement 44 is furthermore provided at the transmission cover 15 in the regions of the fastening means 20 arranged pair-wise, said toothed arrangement 44 cooperating with a corresponding toothed arrangement at the cutting wheel 12 or at the fastening flange 18 and serving an effective torque transmission from the cutting wheel transmission 14 to the cutting wheel 12.

The bores 23 into which the spacer elements 24 can be screwed are furthermore closed by closure screws and the spacer elements 24 are removed from the cutting wheel transmission 14. Alternatively, the spacer elements 24 can be fixedly arranged at the transmission cover 15.

In principle, the centering elements 30 can effect the fine alignment and/or the pushing on of the cutting wheel 12 via a different kind of movement, e.g. a linear placing onto the threaded pins 26 or spacer elements 24. The cutting wheel 12 is, however, advantageously secured again sliding off by a screwing on and a smaller force effect is required. The movement can moreover be controlled better or can be divided among the three centering elements 30.

REFERENCE NUMERAL LIST

1 carrier machine
10 slurry wall cutter

12 cutting wheel
13 cutting tooth
14 cutting wheel transmission/transmission hub
15 transmission cover
16 housing
17 drive unit
18 fastening flange
20 fastening means (pin)
22 fastening means (bore)
23 bore
24 spacer element (spacer pin)
25 cutout (bore)
26 threaded pin
27 threaded bore
28 securing element (nut)
30 centering element (centering cone)
32 conical section
34 first abutment
35 second abutment
36 threaded bore
38 recess
40 precentering element (centering block)
42 cover element (closure screw)
44 toothed arrangement
b1 direction of movement during the fine alignment
b2 direction of movement during the first pushing on by means of the centering elements
b3 direction of movement during the second pushing on by means of the centering elements

The invention claimed is:

1. A method of installing a cutting wheel (12) at a cutting wheel transmission (14) of a slurry wall cutter (10), wherein the cutting wheel transmission (14) and the cutting wheel (12) have fastening means (20, 22) for fastening the cutting wheel (12), positioned linear in a telescoping spatial relationship to at least two spacer elements (24) arranged at the cutting wheel transmission (14), said method having the steps:

guiding the cutting wheel (12) to the cutting wheel transmission (14);

aligning the cutting wheel (12) relative to the cutting wheel transmission (14) so that the fastening means (20, 22) are opposite one another, without contacting one another in so doing;

connecting one respective centering element (30) to the spacer elements (24);

aligning the cutting wheel (12) relative to the spacer elements (24) by means of the centering elements (30), with the fastening means (20, 22) not contacting one another; and displacing the cutting wheel (12) to the spacer elements (24) by the centering elements (30) so that the fastening means (20, 22) come into engagement with one another.

2. A method in accordance with claim 1, wherein the spacer elements (24) and/or the fastening means (20) arranged at the cutting wheel transmission (14) project perpendicular from the outer side of the cutting wheel transmission (14) facing the cutting wheel (12) and distributed over the periphery.

3. A method in accordance with claim 1, wherein the spacer elements (24) come into contact with the cutting wheel (12) on the displacement of the cutting wheel (12) earlier than the fastening means (20), with the spacer elements (24) having a greater length than the fastening means (20) arranged at the cutting wheel transmission (14).

4. A method in accordance with claim 1, wherein the fastening means (20) arranged at the cutting wheel transmission (14) are pins, in particular threaded pins, and the fastening means (22) arranged at the cutting wheel (12) are bores, with the pins (20) being pushed through the bores (22) on the displacement of the cutting wheel (12) relative to the spacer elements (24) and subsequently being secured by securing elements (28), in particular nuts.

5. A method in accordance with claim 1, wherein the centering elements (30) are connected, in particular, screwed to the spacer elements (24) from the side of the cutting wheel (12) remote from the cutting wheel transmission (14) and removed from the spacer elements (24) after the installation of the cutting wheel (12) has taken place.

6. A method in accordance with claim 1, wherein one cutout (25) per spacer element (24) is formed at a fastening flange (18) of the cutting wheel (12), with the spacer elements (24) traveling into the cutouts (25) on the displacement of the cutting wheel (12) relative to them and with the spacer elements (34) remaining at the cutting wheel transmission (14) after installation of the cutting wheel (12) has taken place.

7. A method in accordance with claim 6, wherein the centering elements (30) are connected to the spacer elements (24) through the cutouts (25), preferable via threaded pins (26), with the centering elements (30) being moved, in particular screwed, in the direction of the cutting wheel transmission (14) for the fine alignment and/or the displacement of the cutting wheel (12).

8. A method in accordance with claim 7, wherein the centering elements (30) have a conical section (32) that cooperates with the cutout (25) on the movement in the direction of the cutting wheel transmission (14) and finely aligns the cutting wheel (12) such that the spacer elements (24) are aligned with the associated cutout (25).

9. A method in accordance with claim 8, wherein the centering elements (30) have a peripheral first abutment (34) in the region of the conical section (32), said first abutment (34) contacting the cutting wheel (12) after the fine alignment.

10. A method in accordance with claim 9, wherein the first abutments (34) likewise urge the cutting wheel (12) in the direction of the cutting wheel transmission (14) on the continued movement, in particular screwing, of the centering elements (30) in the direction of the cutting wheel transmission (14) so that the spacer elements (24) travel into the respective cutouts (25).

11. A method in accordance with claim 8, wherein the centering elements (30) are connected to the spacer elements (24) via threaded pins (26) and are movable in the direction of the spacer elements (24) by screwing and have a continuous threaded bore (36) for receiving the threaded pins (26), with the centering elements (30) having a second abutment (35) at their ends remote from the conical sections (32) and being unscrewed from the threaded pins (26) after the displacement of the cutting wheel (12) by a first distance relative to the spacer elements (24) and being screwed to the threaded pins (26) at the other end again until the second abutments (35) abut the cutting wheel (12) so that the cutting wheel (12) is pushed further in the direction of the cutting wheel transmission (14) on a continued screwing.

12. A method in accordance with claim 11, wherein the centering elements (30) have recesses (38) opening into the threaded bores (36) at their ends remote from the conical sections (32), with the spacer elements (24) traveling into the recesses (38) until the fastening means (20, 22) of the cutting wheel (12) and the cutting wheel transmission (14)

are completely in engagement with one another after the repeat screwing onto the threaded pins (26) and the continued displacement of the cutting wheel (12) in the direction of the cutting wheel transmission (14).

13. A method in accordance with claim 1, having at least two precentering elements (40) that are arranged at the side of the cutting wheel (12) facing the cutting wheel transmission (14) and each have a chamfered surface, with the cutting wheel (12) first being pushed onto the cutting wheel transmission (14) via the precentering elements (40) on the guiding toward the cutting wheel transmission (14) and being precentered relative to the cutting wheel transmission (14) via the chamfered surfaces of the precentering elements (40).

14. A kit for carrying out the method in accordance with claim 13 and comprising at least two centering elements (40), at least two spacer elements (24), and at least two threaded pins (26) for connecting the centering elements (30) to the spacer elements (24) and/or at least two precentering elements (40).

15. A slurry wall cutter (10) having at least one cutting wheel transmission (14) and a cutting wheel (12) that can be installed thereat by the method in accordance with claim 1.

16. A slurry wall cutter (10) having at least one cutting wheel transmission (14) and a cutting wheel (12), wherein the slurry wall cutter (10) comprises a kit in accordance with claim 14.

17. A method in accordance with claim 2, wherein the spacer elements (24) come into contact with the cutting wheel (12) on the displacement of the cutting wheel (12) earlier than the fastening means (20), with the spacer elements (24) having a greater length than the fastening means (20) arranged at the cutting wheel transmission (14).

18. A method in accordance with claim 17, wherein the fastening means (20) arranged at the cutting wheel transmission (14) are pins, in particular threaded pins, and the fastening means (22) arranged at the cutting wheel (12) are bores, with the pins (20) being pushed through the bores (22) on the displacement of the cutting wheel (12) relative to the spacer elements (24) and subsequently being secured by securing elements (28), in particular nuts.

19. A method in accordance with claim 3, wherein the fastening means (20) arranged at the cutting wheel transmission (14) are pins, in particular threaded pins, and the fastening means (22) arranged at the cutting wheel (12) are bores, with the pins (20) being pushed through the bores (22) on the displacement of the cutting wheel (12) relative to the spacer elements (24) and subsequently being secured by securing elements (28), in particular nuts.

20. A method in accordance with claim 2, wherein the fastening means (20) arranged at the cutting wheel transmission (14) are pins, in particular threaded pins, and the fastening means (22) arranged at the cutting wheel (12) are bores, with the pins (20) being pushed through the bores (22) on the displacement of the cutting wheel (12) relative to the spacer elements (24) and subsequently being secured by securing elements (28), in particular nuts.

* * * * *